US010549310B2

(12) United States Patent
Sacy et al.

(10) Patent No.: US 10,549,310 B2
(45) Date of Patent: Feb. 4, 2020

(54) DEVICE FOR COATING A TURBOMACHINE ANNULAR CASING

(71) Applicant: SAFRAN AIRCRAFT ENGINES, Paris (FR)

(72) Inventors: Thierry Sacy, Moissy-Cramayel (FR); Patrice Le Bec, Moissy-Cramayel (FR); Philippe Charles Alain Le Biez, Moissy-Cramayel (FR); Serge Georges Vladimir Selezneff, Moissy-Cramayel (FR); Franck Bernard Léon Varin, Moissy-Cramayel (FR); Michel Lenfant, Moissy-Cramayel (FR); Fabrice Marsaleix, Moissy-Cramayel (FR); Jacques Chazal Dufour, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 118 days.

(21) Appl. No.: 15/736,268

(22) PCT Filed: Jun. 10, 2016

(86) PCT No.: PCT/FR2016/051402
§ 371 (c)(1),
(2) Date: Dec. 13, 2017

(87) PCT Pub. No.: WO2016/203141
PCT Pub. Date: Dec. 22, 2016

(65) Prior Publication Data

US 2018/0178243 A1 Jun. 28, 2018

(30) Foreign Application Priority Data

Jun. 18, 2015 (FR) ..... 15 55597

(51) Int. Cl.
*B05C 11/02* (2006.01)
*B05C 5/02* (2006.01)
(Continued)

(52) U.S. Cl.
CPC ..... *B05C 11/023* (2013.01); *B05C 5/0216* (2013.01); *B05C 7/02* (2013.01);
(Continued)

(58) Field of Classification Search
None
See application file for complete search history.

(56) References Cited

U.S. PATENT DOCUMENTS 3,346,175 A 10/1967 Wiles
5,472,315 A 12/1995 Alexander et al.
(Continued)

FOREIGN PATENT DOCUMENTS

EP 2 813 673 A1 12/2014

OTHER PUBLICATIONS

Written Opinion dated Sep. 28, 2016, for International Application No. PCT/FR2016/051402, filed Jun. 10, 2016, 4 pages.
(Continued)

*Primary Examiner* — Shamim Ahmed
*Assistant Examiner* — Bradford M Gates
(74) *Attorney, Agent, or Firm* — Christensen O'Connor Johnson Kindness PLLC

(57) ABSTRACT

A device applies a coating to a surface of an turbomachine annular casing, wherein the casing has an abradable layer obtained by polymerising a resin. The device includes first support means and, optionally, second automated means movable relative to the first support means. The automated means includes means for depositing said resin on the surface of the casing. The automated means further includes means for spreading the resin on the surface of the casing,
(Continued)

and means for unwinding a plastic film that is intended to be interposed between said spreading means and the resin.

20 Claims, 9 Drawing Sheets

(51) Int. Cl.

| | |
|---|---|
| ***B05C 7/02*** | (2006.01) |
| ***B05C 13/02*** | (2006.01) |
| ***F01D 25/28*** | (2006.01) |
| ***B05D 1/02*** | (2006.01) |
| ***F01D 11/12*** | (2006.01) |
| ***F04D 29/52*** | (2006.01) |

(52) U.S. Cl.
CPC ..... *B05C 13/02* (2013.01); *B05D 1/02* (2013.01); *F01D 11/122* (2013.01); *F01D 25/285* (2013.01); *F04D 29/526* (2013.01); *F05D 2220/323* (2013.01); *F05D 2230/90* (2013.01)

(56) References Cited

U.S. PATENT DOCUMENTS

| | | | | |
|---|---|---|---|---|
| 9,587,506 | B2 | 3/2017 | Konigs et al. | |
| 2008/0081109 | A1 | 4/2008 | Johnson et al. | |
| 2014/0367920 | A1* | 12/2014 | Konigs ..... | B29D 99/0053 277/345 |

OTHER PUBLICATIONS

International Preliminary Report on Patentability dated Dec. 19, 2017, for International Application No. PCT/FR2016/051402, filed Jun. 10, 2016, 1 page.
International Search Report dated Sep. 28, 2016, for International Application No. PCT/FR2016/051402, filed Jun. 10, 2016, 5 pages.
Written Opinion dated Sep. 28, 2016, for International Application No. PCT/FR2016/051402, filed Jun. 10, 2016, 5 pages.

* cited by examiner

DEVICE FOR COATING A TURBOMACHINE ANNULAR CASING

TECHNICAL FIELD

The present invention relates to a device for coating a surface of an annular casing of a turbine engine, comprising an abradable layer obtained by polymerisation of a resin.

PRIOR ART

The prior art includes in particular documents FR-A-2 339 741, U.S. Pat. No. 3,346,175 and EP-A1-2 202 264.

A turbine engine includes, at its upstream end (in relation to the flow of gasses in the turbine engine), a fan comprising an impeller which is surrounded by a casing, referred to as a retention casing owing to its function of retaining blades in the event of a breakage of said blades.

In a known manner, the impellers of a turbine engine are surrounded by a stator which has an annular coating made of an abradable material. The coating extends around and in close radial proximity to the blades, which may rub against the material and abrade said material during operation. This makes it possible to optimise the radial clearances between the blades and the stator surrounding said blades, and thus to limit gas leaks at the apexes or radially outer ends of the blades.

In the case of a retention casing, the fan blades are surrounded by an abradable layer which covers an inner annular surface of the casing. In the prior art, this abradable layer is obtained by spreading a polymerisable resin over the surface. Said resin is manually hammered in order to remove as many air bubbles as possible and in order to press the resin onto the casing. The finishing is completed by means of calendering, which is achieved by passing a design rule without any possible control on the force imposed. In addition, said calendering tends to exert a separating force on the resin. It is therefore a manual operation which can involve risk in the metering of components, and it is also an operation which is very restrictive for operators. In addition, said operation requires a lot of experience, which thus means it takes a long time to implement.

The present invention proposes a simple, effective and economical solution to at least some of the above-mentioned disadvantages of the prior art.

DISCLOSURE OF THE INVENTION

The present invention relates to a device for coating a surface of an annular casing of a turbine engine, comprising an abradable layer obtained by polymerisation of a resin, which device is characterised in that it includes:

- first support means, in particular for supporting said casing,
- means for spreading a resin previously deposited on said casing surface, which means are, for example, supported by said first means and designed to spread the resin over said casing surface, and
- means for unwinding a plastics film intended to be interposed between said spreading means and the resin, said unwinding means being, for example, supported by said first means.

The device according to the invention allows at least some of the manual operations from the prior art to be replaced by operations that are automated and thus more easily reproducible. The plastics film prevents the resin from adhering to the spreading means and makes it possible to ensure that the abradable layer has a good surface finish (for example smooth and shiny).

The device according to the invention can include one or more of the following features, taken independently or in combination:

- the device includes second automated means which can move relative to the first support means and comprise means for depositing said resin, which depositing means are designed to deposit the resin on said casing surface,
- said unwinding means are supported by said second means,
- said spreading means are supported by said second means,
- said depositing means include means for preparing said resin by mixing at least two components,
- said preparation means include cartridges for storing the components and means for mixing the components,
- the depositing means include at least one nozzle for ejecting the resin,
- the spreading means include a series of parallel rolls which are mounted so as to rotate freely,
- the unwinding means include at least one plastics film roll,
- the unwinding means include a first roll designed to first come into contact with the resin after it has been deposited and to spread and compress said resin, at least one second roll designed to distribute the resin and expel a surplus of resin towards the longitudinal ends of the second roll, and a third roll designed to calibrate the inner diameter of the resin coating,
- the outer surfaces of the first and third rolls are cylindrical and, for example, made of aluminium, and the outer surface of the second roll is cylindrical and domed substantially at the centre of the roll and, for example, made of plastics material.
- the second means are designed to be able to move along at least two axes, preferably three axes,
- the device includes means for scraping and removing said resin, after it has been deposited on said surface, said scraping means being, for example, mounted so as to be able to move relative to the first support means, preferably independently of said second means, and
- the device includes means for cutting the resin and the plastics film, said cutting means being, for example, mounted so as to be able to move relative to the first support means independently of said second means.

The present invention also relates to an apparatus comprising a device as described above and a carriage for transporting and rotating an annular casing of a turbine engine, said carriage comprising means for rotating the casing about a substantially horizontal spin axis of the casing.

The apparatus according to the invention can include one or more of the following features, taken independently or in combination:

- said rotating means include a flywheel for rotating the casing, at least one pinion connected to the flywheel and designed to engage with a toothed ring supported by the casing, and rollers for supporting and guiding the casing in rotation,
- the carriage includes a flywheel for moving the carriage, for example on rails,
- the device includes attachment means designed to engage with complementary means of the carriage in order to lock said means relative to one another, the device includes stop means, for example comprising rollers, designed to engage with the casing or an element supported by the casing in order to limit or even prevent movements of the casing relative to the device along said axis, the device includes centring means for engaging with the carriage, the device includes at least one presence sensor designed to engage with the carriage, the second means are designed to be inserted at least in part into said casing, and the second means include a controller or automaton which is connected to a control console.

The present invention also relates to a method for coating a surface of an annular casing of a turbine engine, by means of at least one apparatus as described above, which method is characterised in that it includes the following automated steps of:

rotating the casing, depositing resin on said surface, spreading the resin by covering it with a plastics film, said steps preferably being stopped before a complete rotation of the casing. This makes it possible for an operator to manually fill the region extending between the two adjacent circumferential edges of the layer with resin, in order to ensure a faultless joining of said edges.

DESCRIPTION OF THE FIGURES

The invention will be better understood and further details, features and advantages of the invention will become more clearly apparent upon reading the following description, given by way of non-limiting example, and with reference to the accompanying drawings, in which.

DETAILED DESCRIPTION

Figure 1:
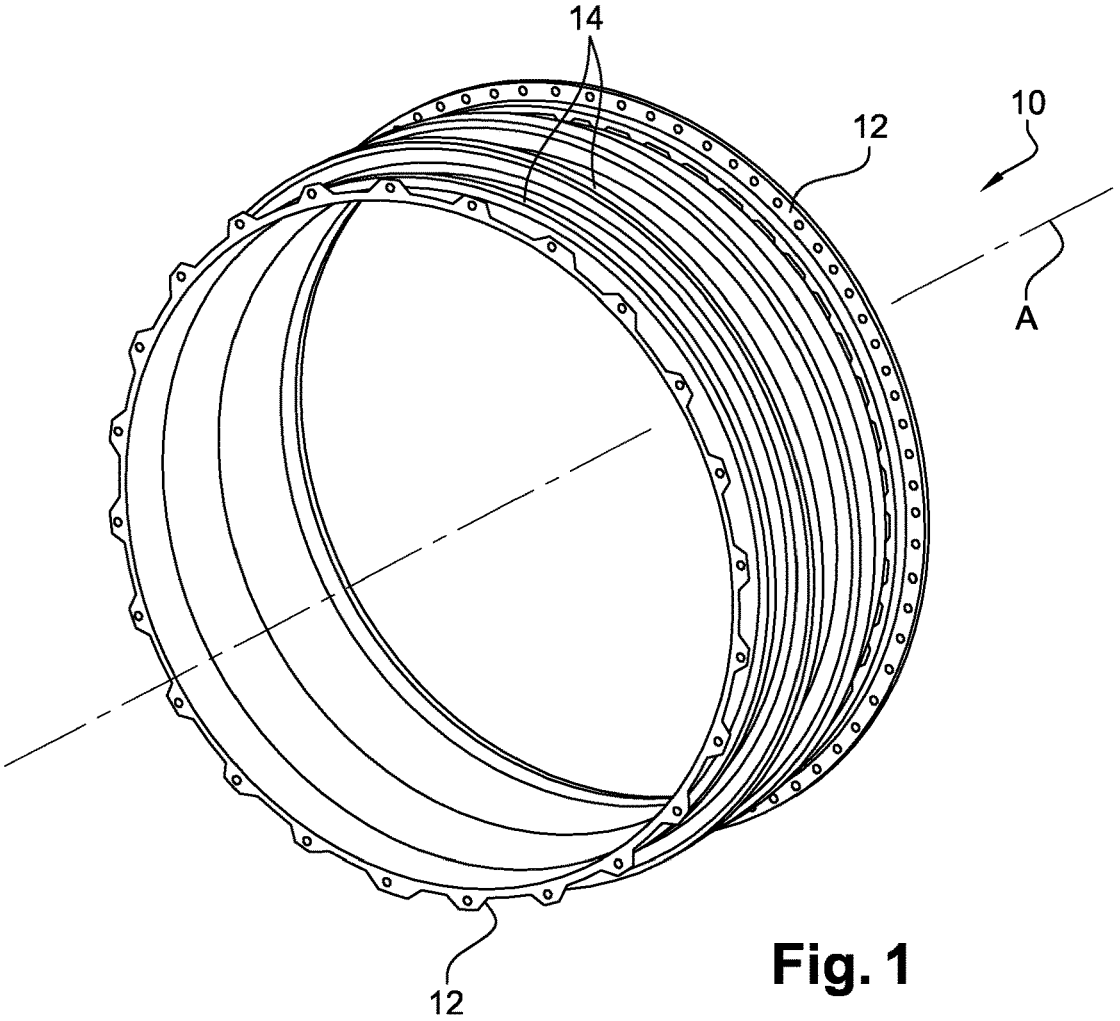
FIG. 1 is a schematic perspective view of an annular retention casing of a turbine engine, said casing comprising an abradable layer.
Figure 2:
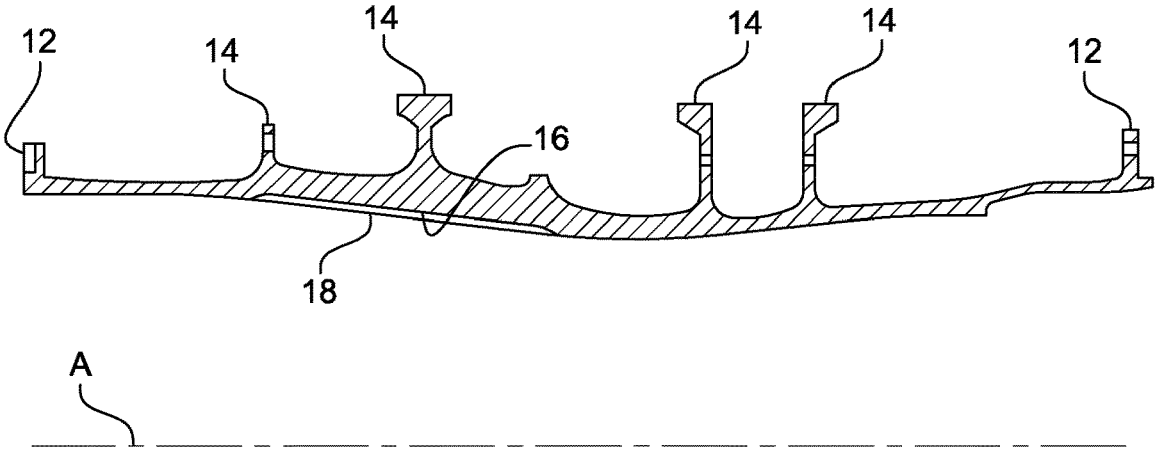
FIG. 2 is a schematic half view in axial section of the casing from FIG. 1.

Reference is first made to FIGS. 1 and 2, which show an annular casing 10 of an aircraft turbine engine. A turbine engine conventionally includes, from upstream to downstream, in the direction of flow of the gases, a fan, at least one compressor, an annular combustion chamber, at least one turbine and a combustion gas exhaust nozzle. The air flow that passes through the fan is divided into a first air flow, referred to as a primary flow or hot flow, which enters the compressor in order to be compressed therein and is then burnt in the chamber, before flowing into the turbine and being ejected into the exhaust nozzle, and a second flow, referred to as a secondary flow or cold flow, which flows between the engine (including the compressor, the combustion chamber and the turbine) and a nacelle of the turbine engine. The fan includes a wheel that turns inside an annular casing such as the casing from FIG. 1, which is commonly known as a retention casing for reasons mentioned above.

The annular casing 10 has a generally substantially cylindrical shape having spin axis A. Said casing includes an annular attachment flange 12 at each of its axial ends. Said flanges 12 are used to attach the casing 10 of the annular walls of the nacelle of the turbine engine. The casing 10 may further include annular stiffeners 14.

The casing 10 includes a radially inner annular surface 16 that is covered by an abradable layer 18. Said layer 18 is continuous over 360° and has a length or axial dimension, along the axis A, which is 20 to 40% of the length of the casing in the example shown. In this case, said layer 18 is located close to the upstream end of the casing 10 and is intended to extend opposite the apex of the blades of the fan wheel. The layer 18 is obtained by polymerisation of a resin which is prepared from at least two components A and B.

The present invention proposes a coating device, in particular for coating the surface 16 of the casing 10 from FIGS. 1 and 2, so as to deposit the abradable layer 18 in a reliable, quick and reproducible manner.

Figure 3:
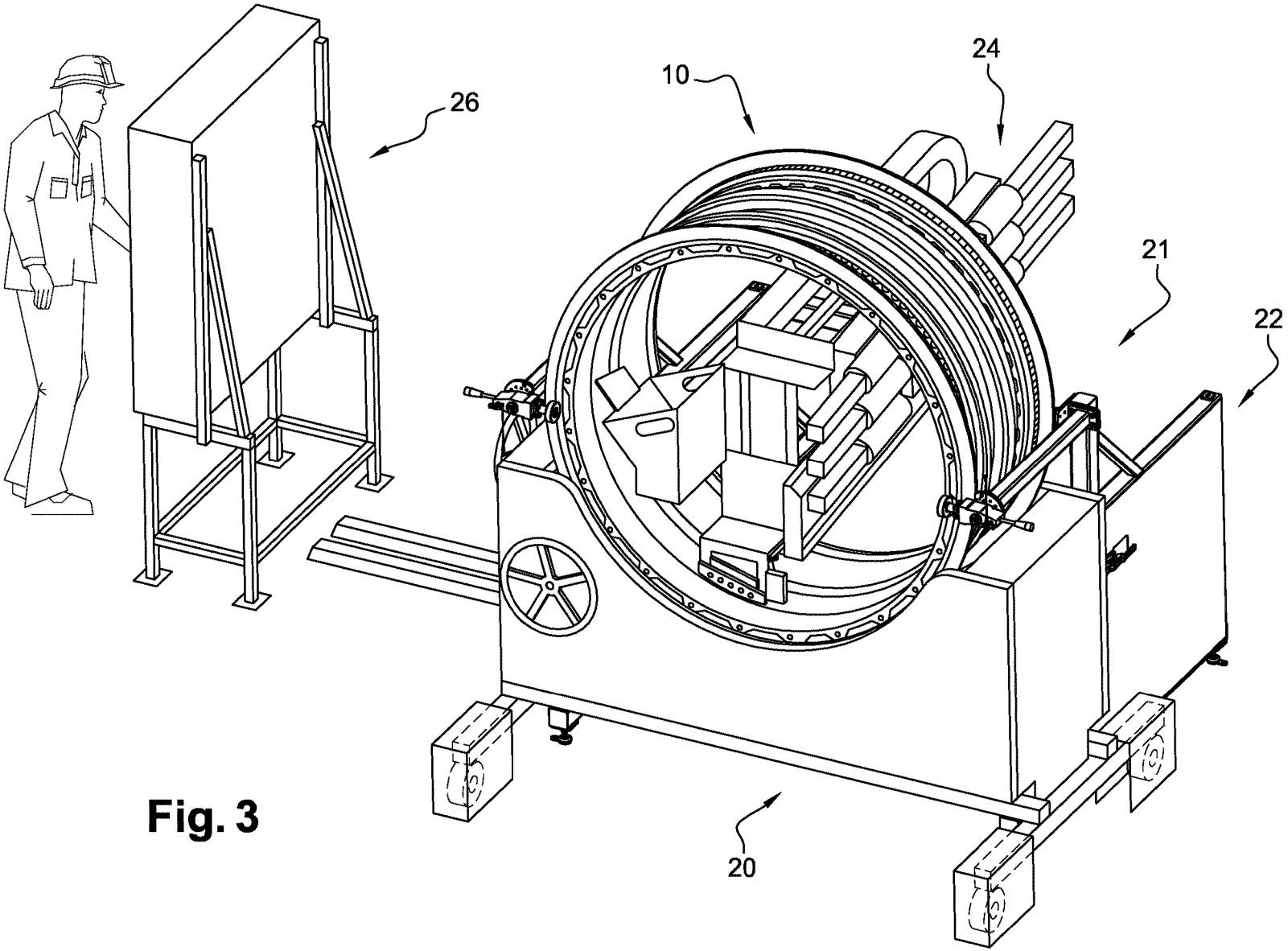
FIG. 3 is a schematic perspective view of an apparatus according to the invention for coating a casing such as the casing from FIG. 1.

FIG. 3 shows an embodiment of an apparatus for coating an annular casing such as that in FIG. 1.

The apparatus includes in particular a carriage 20 for supporting and transporting the casing 10, a coating device 21 comprising a frame 22 for supporting a coating controller 24, and a console 26 for controlling said controller 24.

Figure 4:
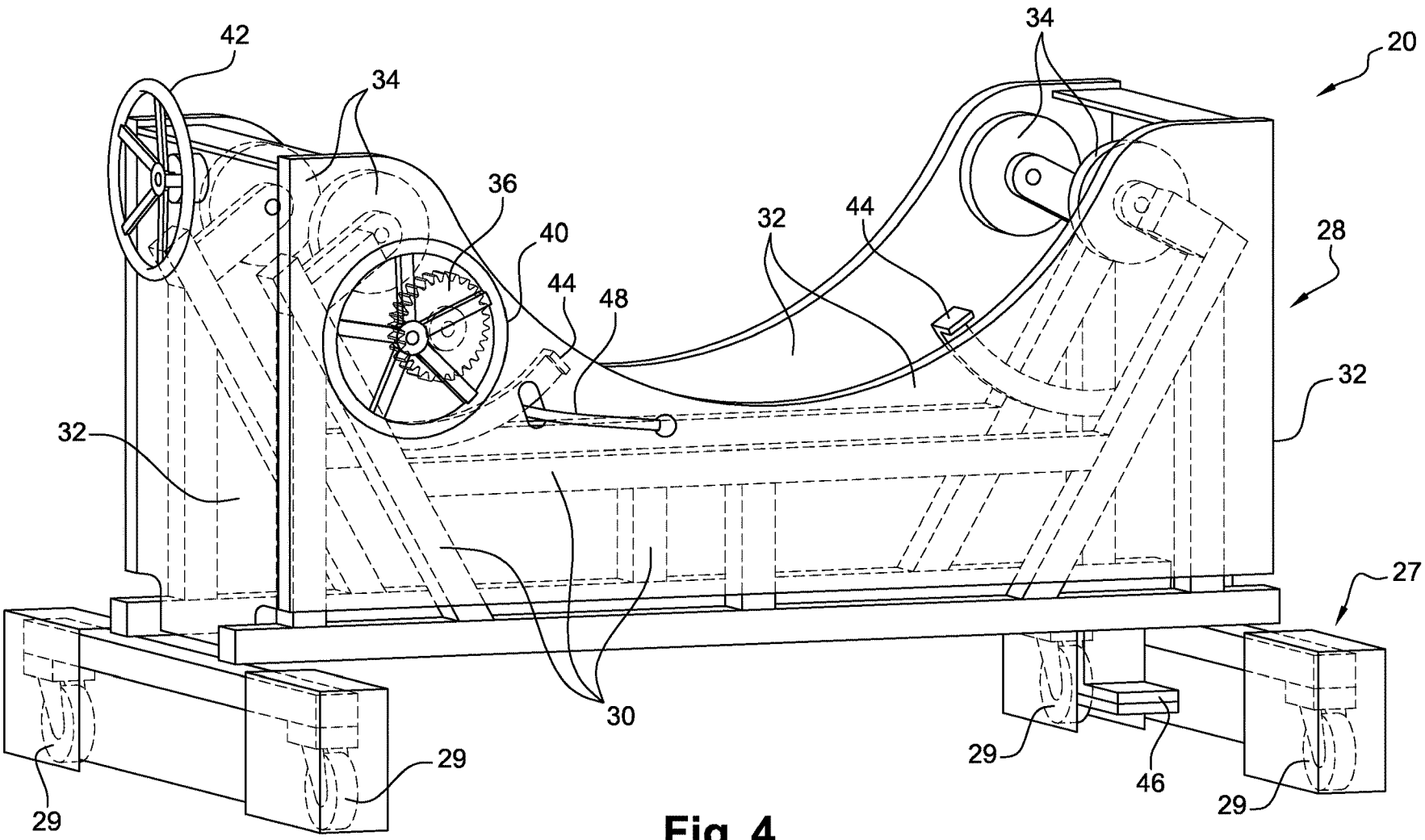
FIG. 4 is a schematic perspective view of a carriage of the apparatus from FIG. 3.

The carriage 20, which can be seen more clearly in FIG. 4, includes a lower framework 27 and an upper body 28 which is generally parallelepiped.

The framework 27 is fitted with wheels 29, in this case numbering four, which allow movements of the carriage, as well as of the casing 10 intended to be placed on the carriage. Said wheels 29 can engage with rails (not shown) in order to guide the carriage during said movements, and in particular in order to move said carriage further away from or closer to the frame 22 supporting the controller 24.

The body 28 of the carriage 20 includes a rigid structure made of metal girders 30 that are mutually attached for example by welding, the structure being surrounded by cowls 32. The general shape of the structure is that of a U or V, comprising a lower, substantially horizontal middle portion and two substantially vertical lateral portions. The casing 10 is intended to be positioned on the carriage 20 such that the lateral portions of the U or V extend on either side of the casing. The front and rear cowls 32 of the body 28 of the carriage each include an upper peripheral edge 34 in a C-shape of which the opening is oriented upwards. The radii of said peripheral edges 34 are similar to the radius of the casing 10, as can be seen in FIG. 3.

The front and rear cowls 32 are preferably separated from one another by a distance greater than the length of the casing 10 such that said casing can be housed between the cowls.

The structure of the body 28 is fitted with rollers 34 for supporting and guiding the casing 10 in rotation. The rollers 34 are mounted so as to rotate freely about axes parallel to the axis A, and number four in the example shown. In this case, said rollers are grouped in pairs, a first pair of rollers 34 being positioned at an upper end of a lateral portion of the structure, and a second pair of rollers being positioned at an upper end of the other lateral portion of the structure.

Figure 7:
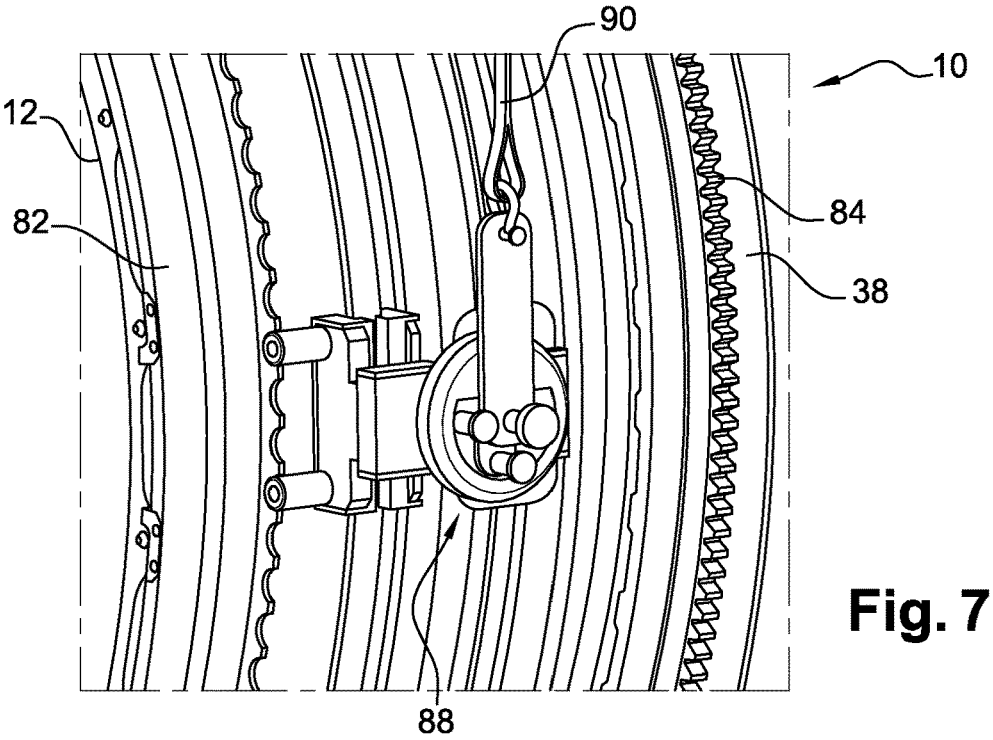
FIG. 7 is a schematic perspective view on a larger scale of a detail of the casing from FIG. 1 and shows means attached to the casing and associated with a lifting sling.

The structure supports at least one pinion 36 having an outer toothing for engaging with a toothed ring 38 (FIG. 7) that is mounted on the casing 10 in order to rotate the casing about the axis A when said casing is placed on the carriage 20 and supported by the rollers 34.

The pinion 36 has a rotational axis parallel to the axis A and is connected to a manually driven flywheel 40. In this case, said flywheel 40 is positioned in the region of the front cowl 32. The carriage includes another driven flywheel 42 in the region of a lateral cowl 32, which is connected to means for moving the carriage on the above-mentioned rails. Said flywheel 42 has a rotational axis perpendicular to the axis A.

The structure also supports a braking system, in this case comprising at least two mechanical brakes 44. The brakes 44 include pads that can be moved between a first position in which they are remote from the casing 10 and a second position in which they abut the casing in order to brake the rotation thereof or lock said casing in rotation. The brakes 44 are moved from the first position into the second position by operating a pedal 46 supported by the framework or the structure. The brakes 44 are released and moved from the second into the first position by operating a lever 48 of the carriage body, which lever passes through an oblong hole in the front cowl 32.

Figure 5:
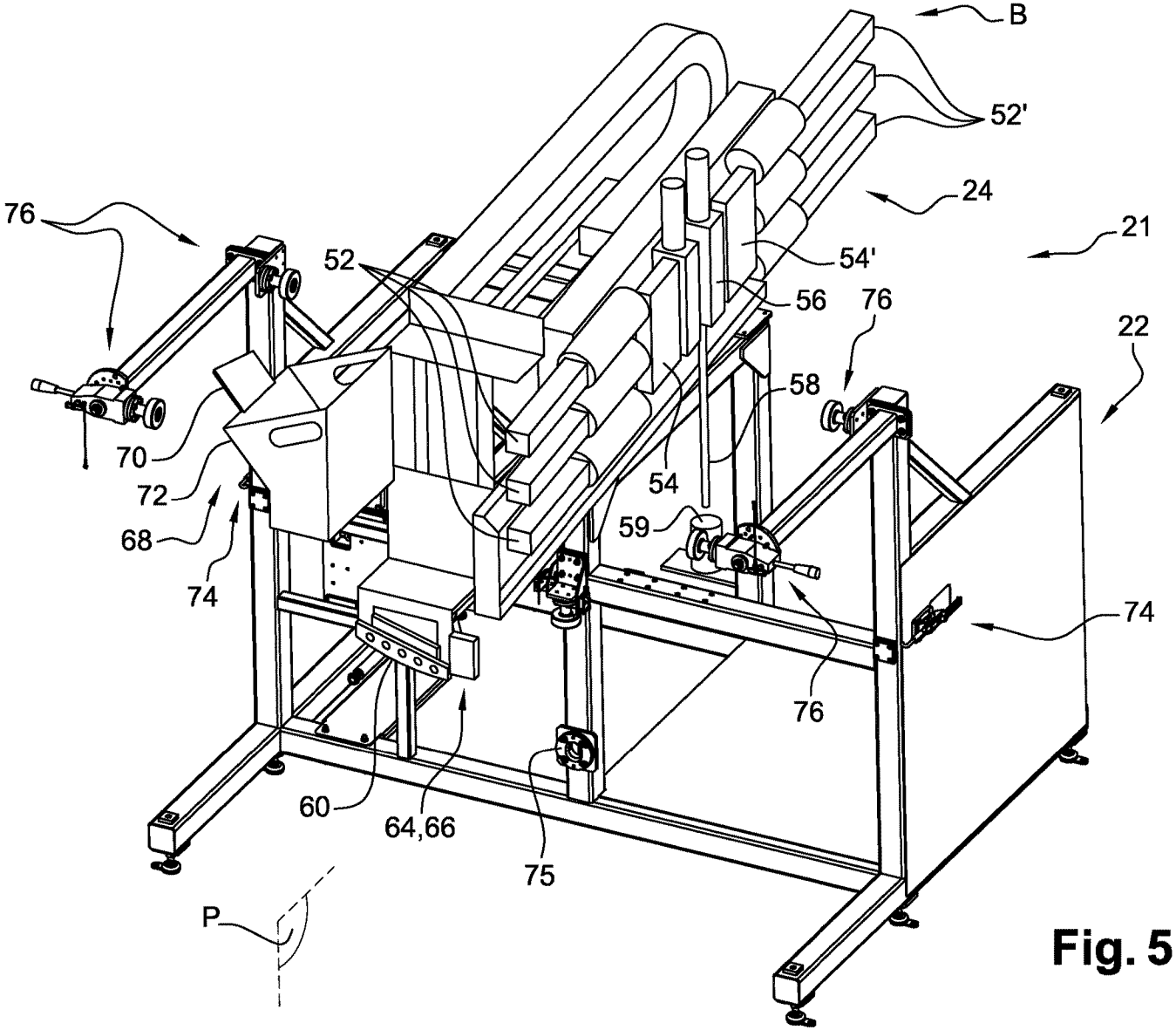
FIG. 5 is a schematic perspective view of a frame supporting a controller for coating the casing from FIG. 1.

The device comprising the frame 22 and the controller 24 can be seen more clearly in FIG. 5. The frame 22 includes a base for resting on the floor and means for supporting the controller 24.

The controller 24 is preferably mounted so as to be able to move on the frame 22 along three axes, and includes a robotic arm controlled by the console 26 and supporting a plurality of pieces of equipment and accessories.

The controller 24 may firstly include means for depositing the resin, which include means for preparing the resin and means for ejecting said resin.

The means for preparing the resin include removable cartridges 52, 52' for storing the components of the resin, and means 56 for mixing said components. In the example shown, in which the resin is obtained by mixing two components, the controller 24 supports a plurality of cartridges 52, 52' of each component. In this case, said controller includes three cartridges 52 of a component A such as a base (including a monomer, for example epoxy) and three cartridges 52' of a component B such as a crosslinking agent or hardener. In this case, the cartridges 52, 52' have a generally elongate cylindrical shape and are arranged in parallel with one another in the same vertical plane B. The three cartridges 52 are arranged in front of the cartridges 52' and the rear ends thereof are connected to a common chamber 54 for receiving component A from the cartridges 52. The three cartridges 52' are aligned with the cartridges 52 and the front ends thereof are connected to a common chamber 54' for receiving component B from the cartridges 52.

The means 56 for mixing components A and B are arranged between the chambers 54, 54'. Said mixing means include, for example, an endless screw mixer 56, which is supplied with components A and B under pressure. Components A and B can be expelled from the cartridges and received in the chambers 54, 54' by means of pressure, for example hydraulic pressure.

The means for preparing the resin may include means for heating the cartridges 52, 52' or chambers 54, 54' in order to optimise the viscosity of the components A and B and in order to minimise the risk of air bubbles forming in the resin.

The components A and B are for example components sold by the company 3M™ under the name Scotch-Weld™ 3524 B/A.

The depositing means include at least one nozzle 58 for ejecting the resin after mixing. In the example shown, the nozzle 58 has a rectilinear elongate shape and extends vertically downwards from the mixer 56. The resin is intended to be expelled from the bottom end of the nozzle 58.

As can be seen in FIG. 5, the cartridges 52, 52', the chambers 54, 54', the mixer 56 and the nozzle 58 extend in the same vertical plane P. The controller is designed to allow movements of all of said elements 52, 52', 54, 54', 56 and 58 in the plane P in particular. It can also be seen that the frame 22 can support a means 59 for recovering resin that leaves the nozzle 58 when the controller is in the stowed, non-operational position.

The frame 22 further includes means for spreading the resin after it has been deposited on the surface 16 of the casing 10 to be coated. In this case, said spreading means include a series of rolls 60 mounted so as to rotate freely about axes parallel to the plane P and about the above-mentioned axis A. Said rolls 60 can be seen more clearly in FIG. 12. In this case, there are five of said rolls, which are arranged alongside one another. Said rolls can be supported by the frame 22 or attached to the controller 24. Said rolls are preferably biased against the surface of the casing 10 to be coated by resilient means, such as springs 62, for example.

Figure 12:
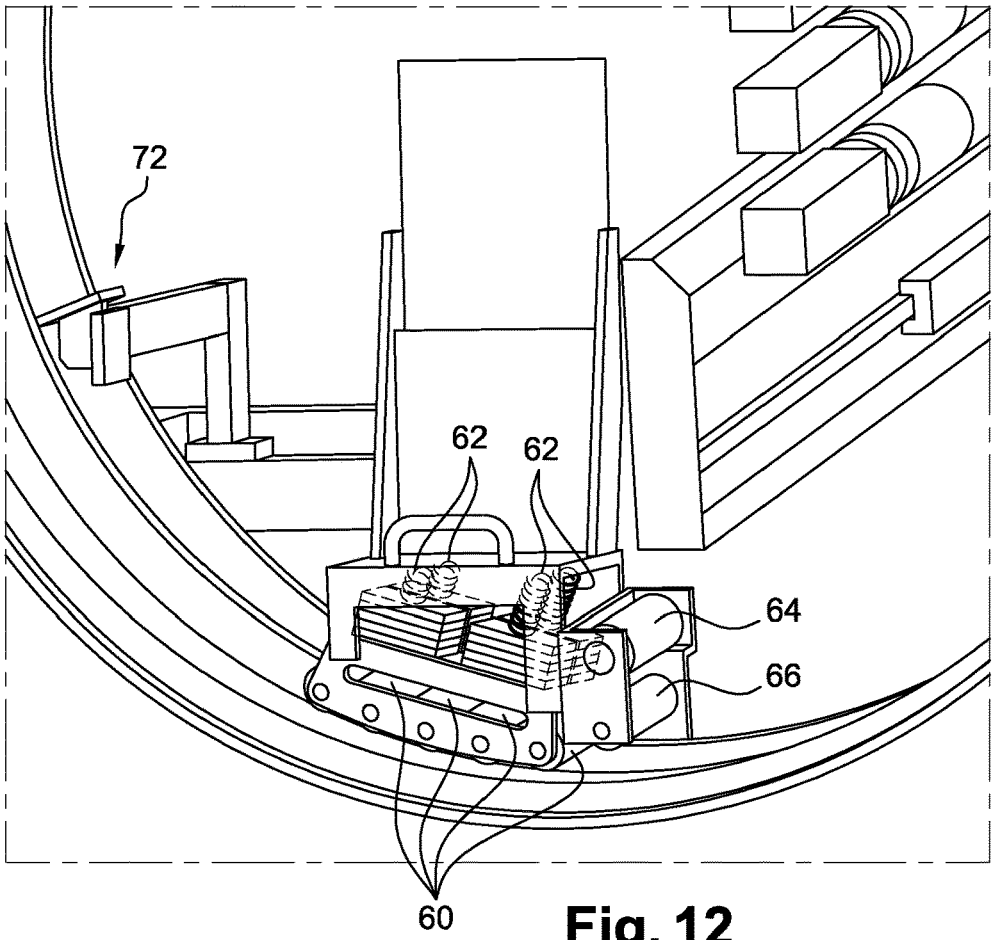
FIG. 12 is a schematic perspective view of the apparatus from FIG. 3 and shows another step of the coating method according to the invention.

The resin ejected by the nozzle 58 is thus intended to be spread and shaped into layers by means of the rolls 60. However, a plastics film is interposed between the resin and the rolls 60 in order to facilitate said spreading operation and address the risk of the resin adhering to the rolls 60. Covering with the plastics film spreads the resin. For this purpose, the frame 22 includes at least one plastics film reel 64 (FIGS. 5 and 12). The reel 64 supports a roll of plastics film which rotates freely about an axis parallel to the axes of the rolls 60. The plastics film unwinds and is driven by the rolls 60 simply by means of the film adhering to the rolls and the resin. The reel 64 can be associated with a roll 66 for guiding the plastics film, as can be seen in FIG. 12.

Figure 14:
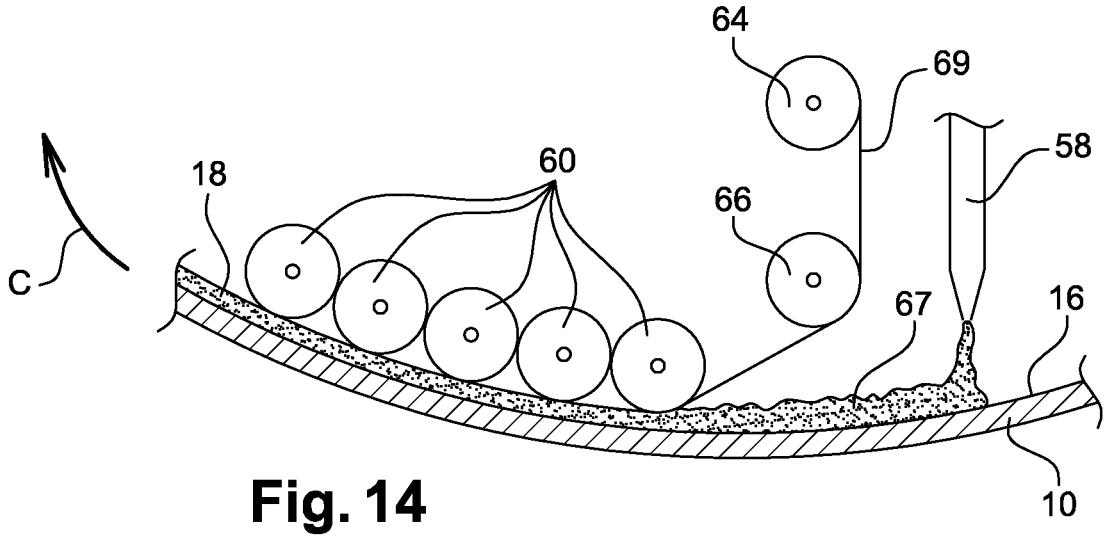
FIG. 14 is a highly schematic view showing the step of depositing the resin of the method according to the invention.

It can be seen in FIG. 14 that the reel 64 and the guiding roll 66 are positioned as a whole between the series of rolls 60 and the nozzle 58 when the controller is in operation. As will be explained in more detail in the following, when the casing 10 is being coated, said casing rotates clockwise in the example shown (arrow C), the resin 67 is deposited by the nozzle 58 on the surface 16 to be coated and comes into contact with the film 69 before being spread by the rolls 60.

The film 69 is preferably a polyester film such as a polyethylene terephthalate film. Said film can have a thickness of approximately 0.125 mm.

As can be seen in FIG. 5, the frame 22 also supports scraping means 68 which are designed to scrape the coated surface 16 of the casing 10 if there is a defect of said coating or a problem that occurred during the coating. Indeed, it is possible that the coating achieved is not satisfactory. By means of the apparatus according to the invention, it is thus possible to remove the previously deposited resin, preferably before the complete polymerisation thereof, in order to facilitate said removal.

In this case, the scraping means 68 include a scraper 70 for scraping the coated surface 16 of the casing 10 and for removing the resin which is then discharged into a storage container 72. Said scraping means can be supported by the controller 24 or connected to the frame 22 so as to be able to move between at least two positions, a first stowed, non-operational position and a second operational position.

The frame 22 also includes means 74 for attachment to the carriage 20 so as to be able to lock the carriage relative to the frame and vice versa. Said attachment means 74 are, for example, snap locks, which can be seen more clearly in FIG. 10.

The frame 22 also includes centring means 75 for engaging with the carriage 20. Said frame can further include at least one device for sensing the presence of the carriage.

Figure 11:
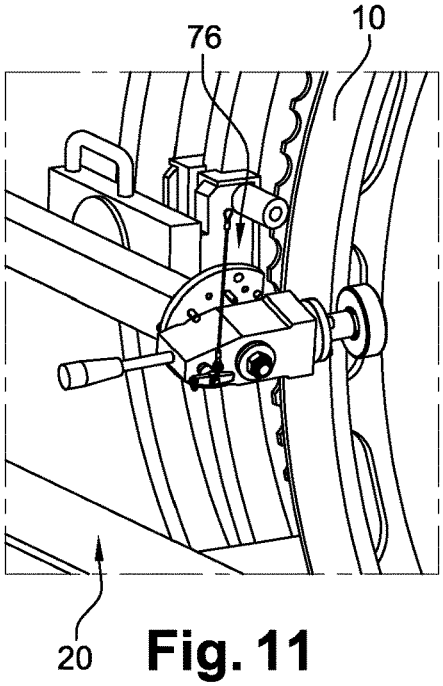
FIG. 11 is a schematic perspective view of means for retaining the retention casing relative to the frame from FIG. 5.

The frame 22 also includes means 76 for retaining the casing 10 relative to the frame 20 so as to prevent movements of the casing relative to the frame in directions parallel to the axis A. Said retaining means 76 include, for example, rollers of which some (rear rollers) are stationary and the others (front rollers) can move between a position for locking and retaining the casing, which can be seen in FIGS. 5 and 11, and a position for unlocking and releasing the casing in order to allow it to move.

Figure 13:
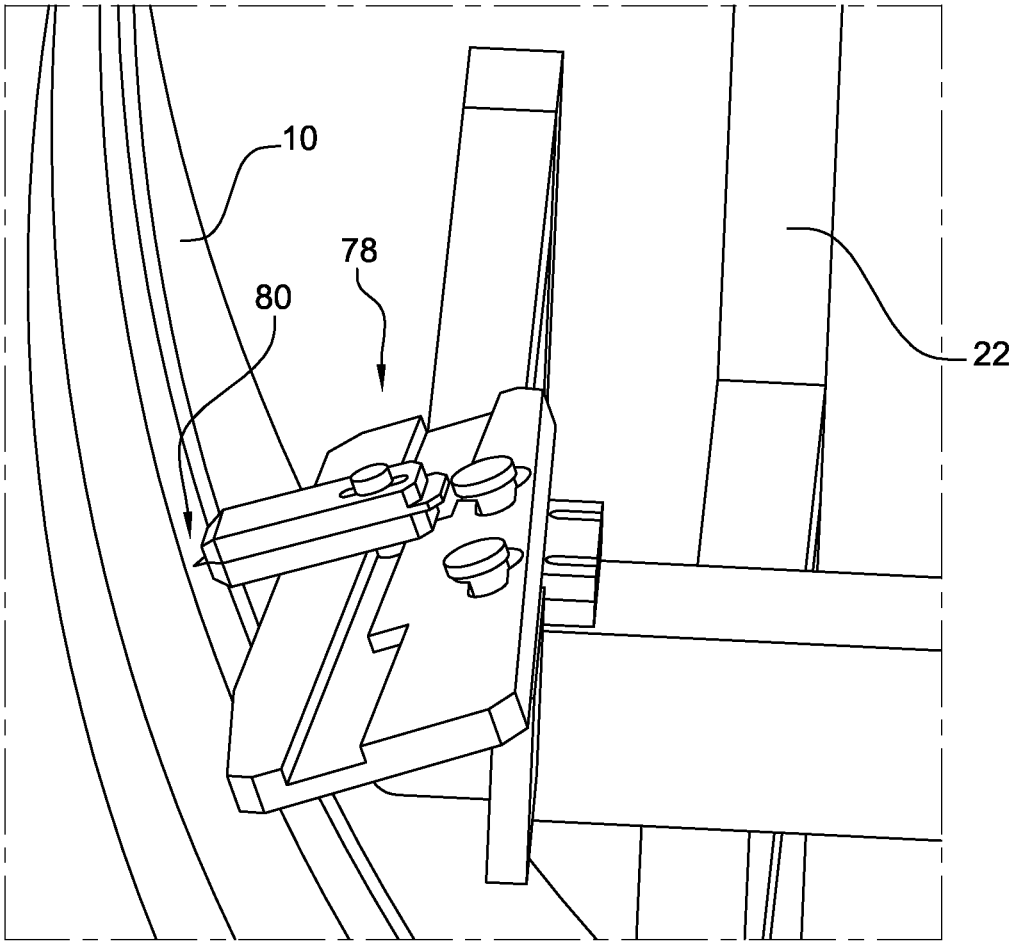
FIG. 13 is a schematic perspective view of a cutting tool of the apparatus from FIG. 3 and shows another step of the coating method according to the invention.

The frame 22 further includes means 78 for cutting the resin and the plastics film, such as those shown in FIG. 13. Said cutting means 78 include a blade 80 which is moved in translation along the axis A in order to cut the resin and precisely define a circumferential end of the layer 18. The blade 80 has a height which is determined in order to cut the layer through the entire depth thereof without coming into contact with the casing.

Figure 6:
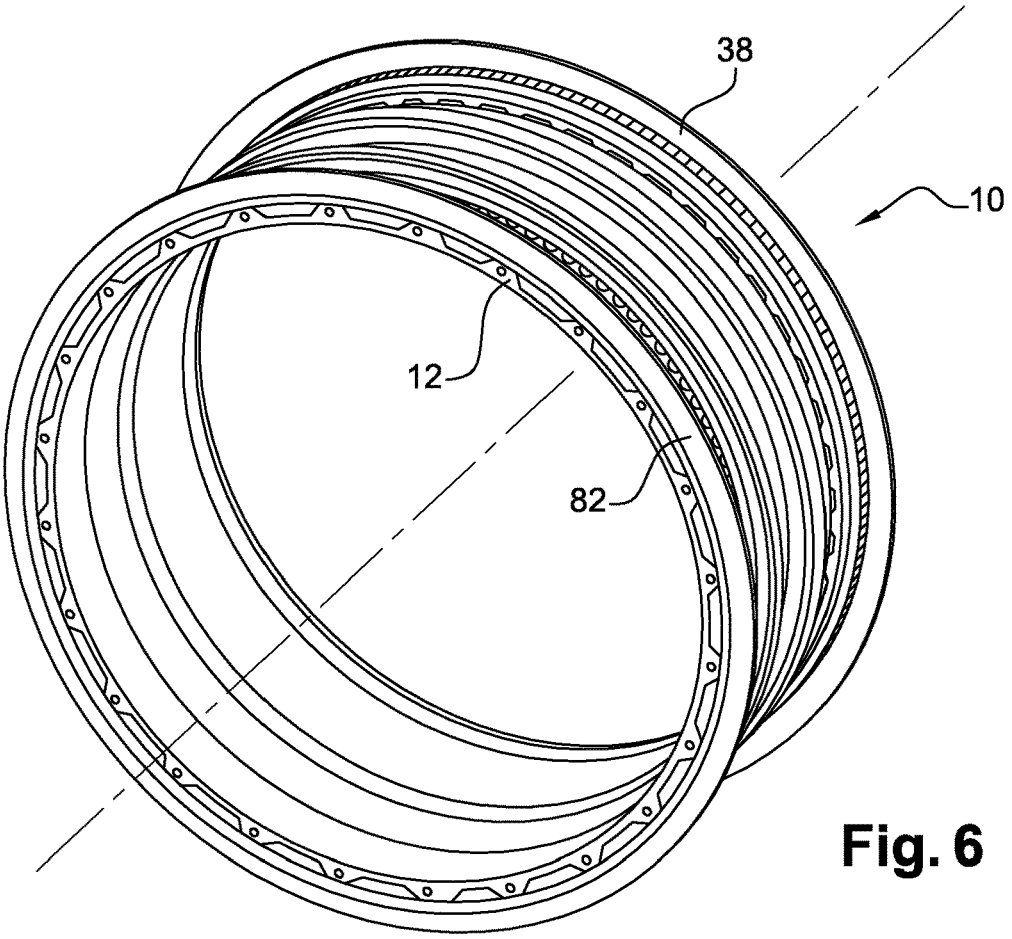
FIG. 6 is a schematic perspective view of the casing from FIG. 1 on which rings have been mounted, which rings have been divided into sectors according to a step of the coating method according to the invention.

Reference is now made to FIG. 6 and subsequent figures, which show an embodiment of the method according to the invention for coating the casing 10 from FIG. 1.

A first step of the method consists in mounting two rings 38, 82 on the axial ends of the casing 10, respectively. Said rings are intended not only to protect the casing 10 but also to allow it to rotate by means of the flywheel 40 and the pinion 36. The rings are removably attached to the flanges 12 of the casing 10 and are preferably divided into sectors in order to make it easier to mount and dismount said rings. The ring 38 includes an outer annular toothing 84 designed to engage with the pinion 36 of the carriage. Each ring 38, 82 can engage with a pinion 36 of the carriage.

Another step of the method consists in mounting lifting means 86 on the casing 10. Said lifting means include means 88 for attachment to the casing and, for example, to the stiffeners 14 of the casing 10 and lifting slings 90.

Figure 8:
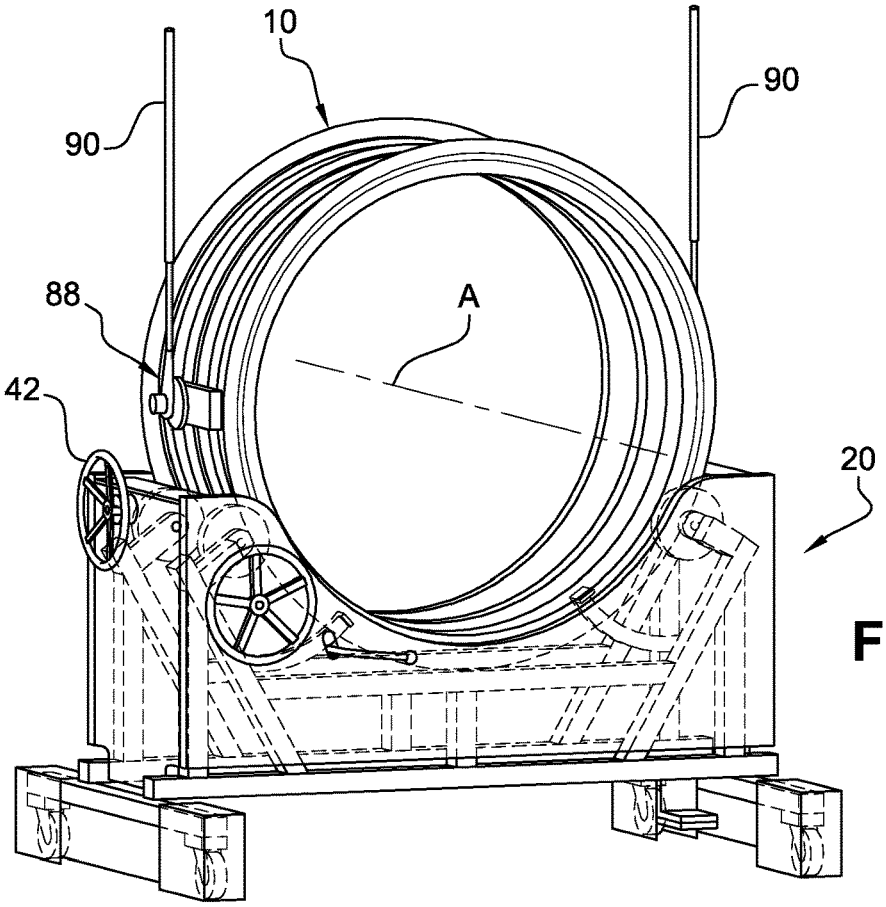
FIGS. 8 and 9 are schematic perspective views of the apparatus from FIG. 3 and shows steps of the coating method according to the invention.

As can be seen in FIG. 8, the casing 10 is provided with two diametrically opposed attachment means 88 connected to two slings 90, respectively. The casing 10 is moved into a position in which its spin axis A is substantially horizontal. Said casing is then brought over the carriage 20 and lowered until the casing abuts the rollers 34 of the carriage 20. During this step, the carriage is preferably stationary and the brakes 44 thereof are preferably applied.

Figure 9:
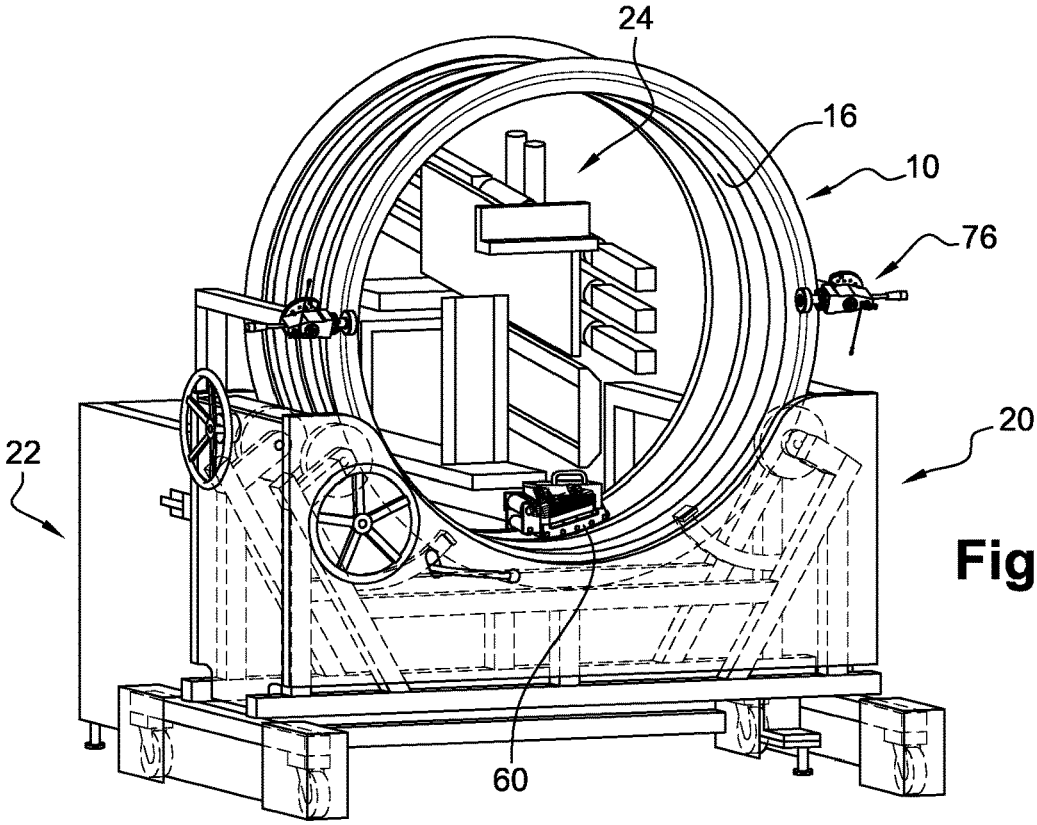
Figure 10:
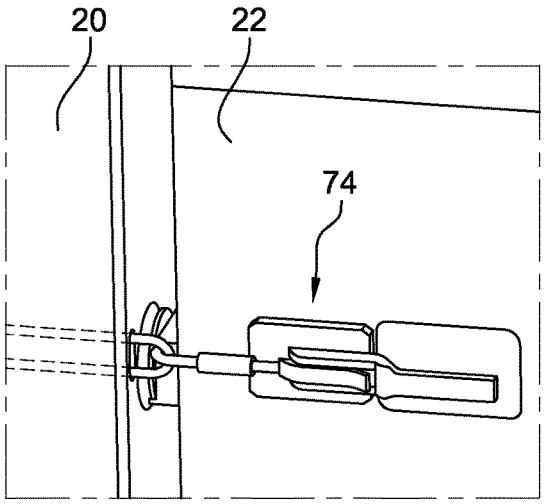
FIG. 10 is a schematic perspective view of means for rigidly connecting the carriage from FIG. 4 to the frame from FIG. 5.

The slings 90 are detached and the carriage 2 can then be moved on the rails (not shown) by means of the flywheel 42, as far as a position in which the carriage can be locked relative to the frame 22 by means of the snap locks 74 in FIG. 10. In this position, the casing 10 bears on the stationary rollers 76 of the frame and some pieces of equipment and accessories of the frame 22 and of the controller 24 are located at least in part inside the casing, as can be seen in FIG. 9. The movable rollers 76 are folded down in order to lock the casing 10 relative to the frame 22.

A portion of the plastics film of the roll 64 is drawn by an operator and slid between the rolls 60 and the surface 16 of the casing 10 to be coated. The brakes 46 of the carriage can then be released by the lever 48 so as to allow a rotational movement of the casing 10 about its axis A.

The controller 24 is then controlled to start the steps of preparing the resin and depositing the resin on the surface 16 of the casing 10 to be coated (FIG. 14). For this purpose, the nozzle 58 can be moved repeatedly along the axis A from the front to the rear and from the rear to the front in order to deposit strands of resin on the surface 16. The resin first comes into contact with the plastics film and then is shaped into layers by the pressure generated by the series of rolls 60. When coming out of the rolls 60, the layer 18 has a uniform thickness and preferably has no air bubbles (FIG. 14).

As can be seen in FIG. 12, the cutting means 78 from FIG. 13 are located at a distance from the rolls 60 in order not to impede the operation of spreading the resin. The cutting means are, for example, located at 70° clockwise of the nozzle 58. Thus, when the casing 10 is coated with a layer 18 over 70° of its angular extent, the free circumferential end of the layer 18 corresponding to the start of the deposition can be cut in order to define a perfectly rectilinear end edge.

When the casing 10 is coated with a layer over close to 360° of its angular extent, the free circumferential end of the layer corresponding to the end of the deposition can be cut in order to define another perfectly rectilinear end edge. The two end edges of the layer corresponding to the start and the end of the deposition of the resin are preferably at an angular distance from one another, for example of a few centimetres. This space can be manually filled in with resin in order to ensure a perfect finish and a perfect joint between said end edges. Said joint is preferably positioned on the casing at 12 o'clock, using the analogy of a clock face. It is therefore understandable that the steps of rotating the casing, depositing resin on the surface of the casing, and spreading resin by means of the plastics film, are stopped before a complete rotation of the casing. The casing 10 can thus be stored in a place that is conducive to the complete polymerisation of the resin.

Figure 15A:
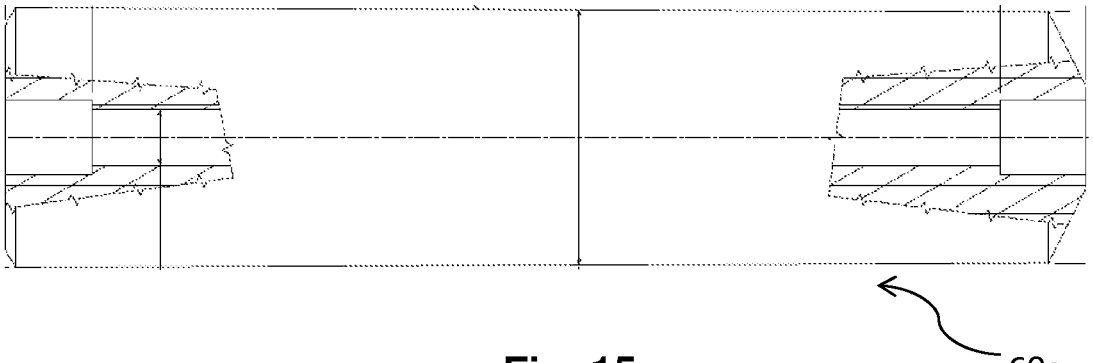
FIGS. 15*a* to 15*c* are schematic views in axial section of rolls, of the apparatus, for spreading the resin.
Figure 15B:
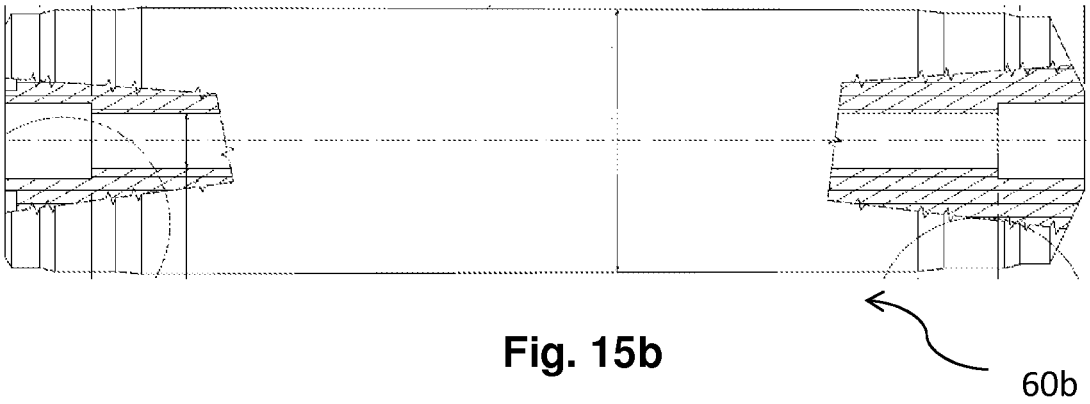
Figure 15C:
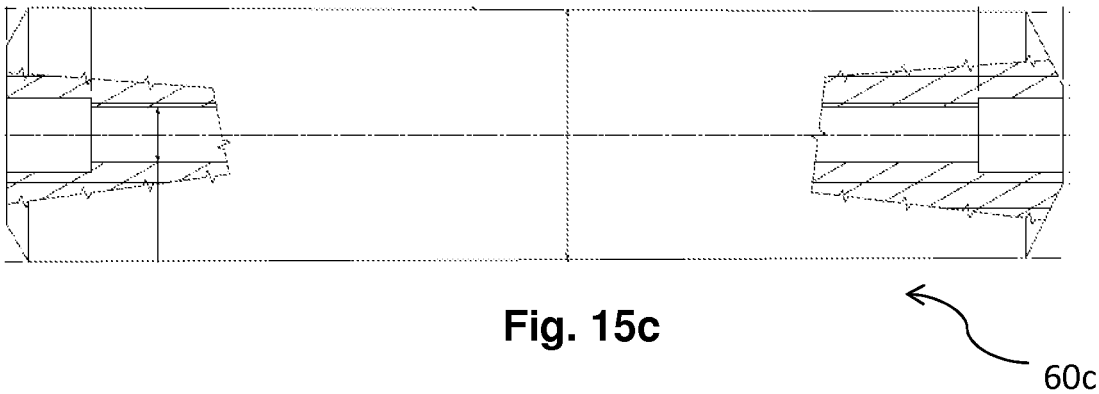

FIGS. 15*a* to 15*c* show a preferred embodiment of the rolls of the spreading means of the device or of the apparatus according to the invention. There are three different types, each type comprising at least one roll.

FIG. 15*a* illustrates a first type of roll. The first roll 60*a*, namely the roll which is intended to come into contact with the resin after it has been deposited on the casing, is designed to spread and compress the resin. The roll 60*a* thus applies pressure against the resin in order to force it against the casing. This is made possible by the fact that the thickness of the resin deposited upstream of the roll is greater than the gap between the roll and the casing. The roll 60*a* has a length and a diameter that are determined so that its longitudinal ends abut and roll on the casing, preferably on peripheral tracks provided on either side of an annular groove for receiving the resin. The first roll preferably has an outer cylindrical surface. Said roll is made of aluminium, for example.

FIG. 15*b* shows a second type of roll. The second roll 60*b* and, preferably, each of the rolls 60*b* arranged between the first roll and the last roll are designed to remove the excess resin deposited in the groove. This is made possible by the fact that the roll 60*b* is cylindrical and domed at the centre thereof. In other words, the outer surface of the roll 60*b* has a concavely curved shape in axial cross section, the convexity of which shape is oriented radially outwards. The maximum diameter of the roll, half-way between its longitudinal ends, is determined for example such that a portion of the roll enters the groove, and the minimum diameter of the roll, in the region of its ends, is determined so as to leave a clearance between the roll and the aforementioned tracks in order to discharge said excess resin towards the ends of the roll. The second roll is made of plastics material, such as PTFE, for example.

FIG. 15*c* shows a last or third type of roll. The last roll 60*c*, namely the roll which is intended to come into contact with the resin (the third roll when the spreading means include only three rolls), is designed to calibrate the inner diameter of the resin coating. The roll 60*c* is similar to the roll 60*a*. The roll 60*c* has a length and a diameter that are determined so that its longitudinal ends abut and roll on the casing, preferably on the aforementioned tracks. Said roll preferably has an outer cylindrical surface. Said roll is made of aluminium, for example.

The invention claimed is:

1. A device for coating a surface of an annular casing of a turbine engine, the annular casing having an abradable layer obtained by polymerisation of a resin, the device comprising:

first support means;

means for spreading a resin previously deposited on said casing surface, said spreading means being supported by said first support means and configured to spread the resin over said casing surface; and means for unwinding a plastics film to be interposed between said spreading means and the resin, said unwinding means being supported by said first support means.

2. The device according to claim 1, wherein said device further includes second automated means moveable relative to the first support means and comprising means for depositing said resin, which depositing means are designed to deposit the resin on said casing surface.

3. The device according to claim 2, wherein said depositing means include means for preparing said resin by mixing at least two components.

4. The device according to claim 3, wherein said preparation means include cartridges configured to store the components and means for mixing the components.

5. The device according claim 2, wherein the depositing means include at least one nozzle configured to eject the resin.

6. The device according to claim 2, wherein the second means are configured to move along at least two axes.

7. The device according to claim 2, wherein said device includes means for cutting the resin and the plastics film, said cutting means being mounted to move relative to the first support means independently of said second means.

8. The device according to claim 1, wherein the spreading means include a series of parallel roll which are mounted to rotate freely.

9. The device according to claim 1, wherein the unwinding means include at least one plastics film roll.

10. The device according to claim 1, wherein the spreading means include a first roll configured to first come into contact with the resin after it has been deposited and to spread and compress said resin, at least one second roll configured to distribute the resin and expel a surplus of resin towards the longitudinal ends of the second roll, and a third roll configured to calibrate the inner diameter of the resin coating.

11. The device according to claim 10, wherein the outer surfaces of the first and third rolls are cylindrical, and the outer surface of the second roll is cylindrical and domed substantially at the centre of the roll.

12. The device according to claim 10, wherein the outer surfaces of the first and third rolls are made of aluminium and the outer surface of the second roll is made of plastics material.

13. The device according to claim 1, wherein said device includes means for scraping and removing said resin, after it has been deposited on said surface, said scraping means being mounted to move relative to the first support means.

14. An apparatus comprising a device according to claim 1 and a carriage for transporting and rotating an annular casing of a turbine engine, said carriage comprising means for rotating the casing about a substantially horizontal spin axis of the casing.

15. The apparatus according to claim 14, wherein said rotating means include a flywheel configured to rotate the casing, at least one pinion connected to the flywheel and configured to engage with a toothed ring supported by the casing, and rollers for supporting and guiding the casing in rotation.

16. The apparatus according to claim 14, wherein the carriage includes a flywheel configured to move the carriage on rails.

17. The apparatus according to claim 14, wherein the device includes at least one of:

attachment means configured to engage with complementary means of the carriage to lock said means relative to one another, and stop means configured to engage with at least one of the casing and an element supported by the casing to limit or even prevent movements of the casing relative to the device along said axis.

18. The apparatus according to claim 14, wherein the second means are designed to be inserted at least in part into said casing.

19. The apparatus according to claim 14, wherein the second means include a controller connected to a control console.

20. A method for coating a surface of an annular casing of a turbine engine, by means of an apparatus according to claim 19, the method comprising the automated steps of:

rotating the casing, depositing resin on said surface, spreading the resin by covering the resin with a plastics film, said steps being stopped before a complete rotation of the casing.

* * * * *